United States Patent [19]

Marquam et al.

[11] Patent Number: 4,509,268

[45] Date of Patent: Apr. 9, 1985

[54] DENTAL CURET SHARPENING GUIDE

[76] Inventors: Barbara J. Marquam, 7321 SW. Corbett, Portland, Oreg. 97219; Dana J. Lillie, 2375 S. Dogwood Ter., Cornelius, Oreg. 97113

[21] Appl. No.: 641,363

[22] Filed: Aug. 15, 1984

Related U.S. Application Data

[63] Continuation of Ser. No. 295,693, Aug. 24, 1981, abandoned.

[51] Int. Cl.[3] ..... B24B 3/36

[52] U.S. Cl. ..... 33/201; 33/481; 33/424; 51/59 R; 51/239; 51/214; 76/82

[58] Field of Search ..... 51/59 R, 238 R, 238 S, 51/238 T, 220–221 R, 220–221 BS, 241 G, 239, 214, 285, 286, 326; 76/82, 82.2, 36, 74, 88, 89; 128/304; 33/201, 202, 481, 424–426

[56] References Cited

U.S. PATENT DOCUMENTS

| | | | |
|---|---|---|---|
| 1,100,418 | 6/1914 | Christopherson | 76/88 |
| 1,125,010 | 1/1915 | Doner | 33/481 |
| 1,391,763 | 9/1921 | Dickinson | 51/166 R |
| 1,498,283 | 6/1924 | Kelsey | 51/221 R |
| 1,605,784 | 11/1926 | Schmidt | 51/220 |
| 1,991,034 | 2/1935 | Stella | 51/214 |
| 2,287,910 | 6/1942 | Slack | 51/59 R |
| 2,323,319 | 7/1943 | Finnell | 76/74 |
| 2,324,025 | 7/1943 | Revell | 51/59 R |
| 2,578,081 | 12/1951 | Miller et al. | 51/59 R |
| 2,861,349 | 11/1958 | Olsen et al. | 76/36 |
| 2,901,834 | 9/1959 | Miller | 33/202 |
| 3,012,450 | 12/1961 | Pancho, Sr. et al. | 76/36 |
| 3,436,872 | 4/1969 | Warren | 51/218 R |

FOREIGN PATENT DOCUMENTS

| | | | |
|---|---|---|---|
| 496750 | 10/1953 | Canada | 76/36 |
| 127701 | 3/1950 | Sweden | 51/59 R |
| 115922 | 5/1918 | United Kingdom | 51/59 R |

*Primary Examiner*—Frederick R. Schmidt
*Assistant Examiner*—Robert Rose

[57] ABSTRACT

A sharpening guide for dental curets. A base member is provided having thereon a positioning point, sighting sections and stone guide lines. A dental curet is aligned with the guide and a sharpening stone applied thereto to correctly sharpen the blade of the instrument.

4 Claims, 7 Drawing Figures

FIG. 1
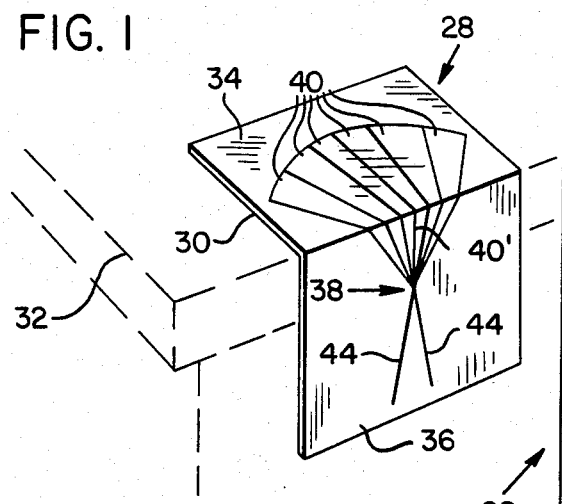
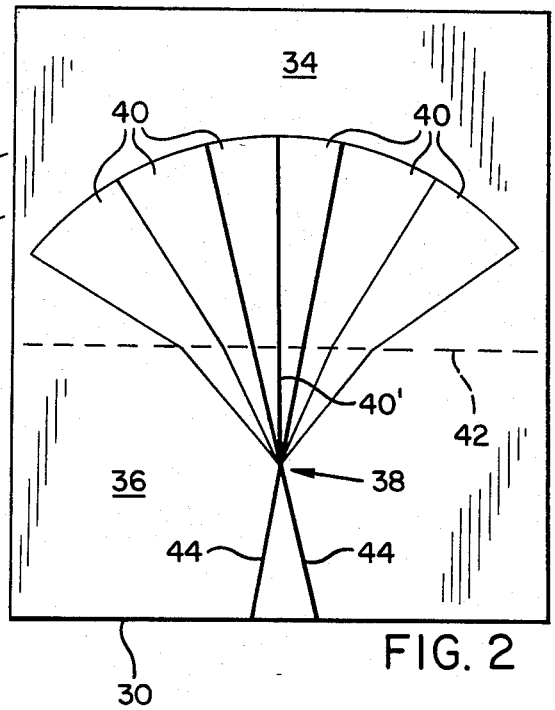
FIG. 2
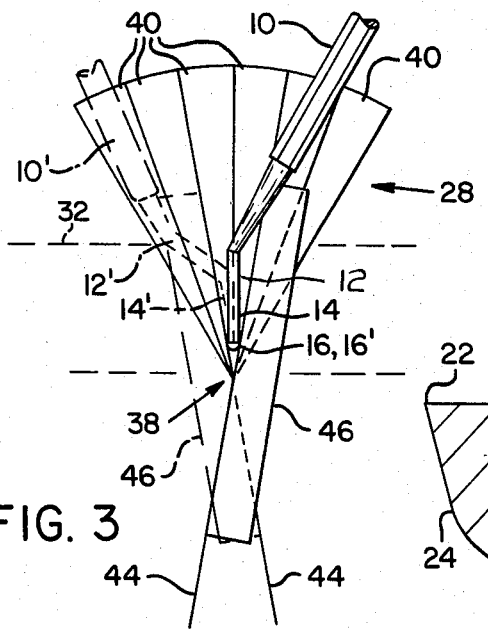
FIG. 3
FIG. 5
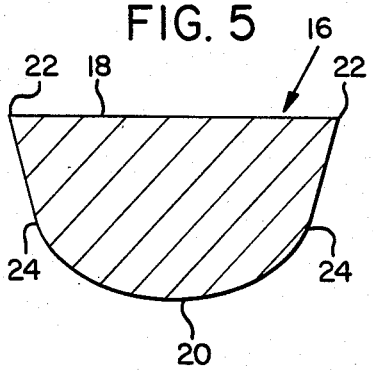
FIG. 6
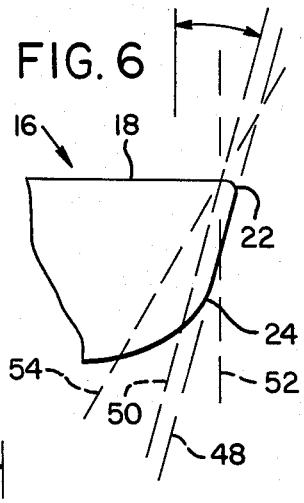
FIG. 4
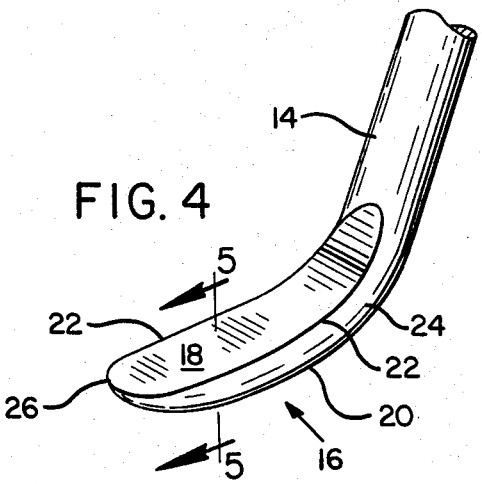
FIG. 7
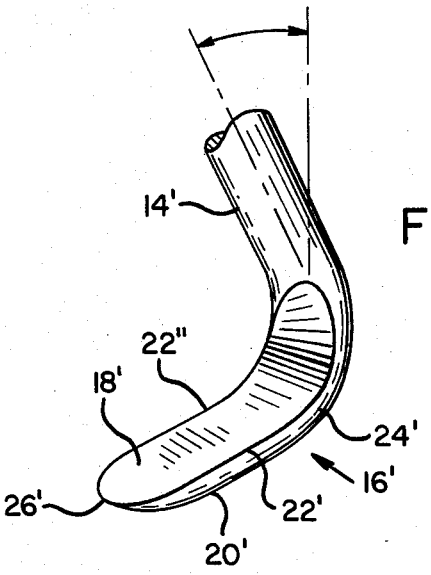

DENTAL CURET SHARPENING GUIDE

This application is a continuation of application Ser. No. 295,693, filed Aug. 24, 1981, abandoned.

BACKGROUND OF THE INVENTION

This invention relates to a tool sharpening apparatus and method. It particularly pertains to a sharpening guide and a procedure for using the guide for sharpening dental curets.

Dental curets are used to scrape the calculus deposits from tooth surfaces, to smooth roughened and diseased root surfaces, and to surgically incise diseased gum tissue.

Normal use against these rough or abrasive surfaces tends to dull the curet's cutting edge. To function efficiently, curets must be correctly sharpened at frequent intervals.

Prior methods of sharpening curets involve various free-hand techniques, all of which are prone to error. Even an individual experienced in the use of dental curets may not understand correct sharpening procedure and may thus destroy the edge of the curet by incorrect sharpening.

A common sharpening error encountered is failure to restore the cutting edge to the proper angle. Another common error is failure to maintain the proper blade shape with the cutting edges parallel and the toe smoothly rounded.

SUMMARY OF THE INVENTION

Accordingly, it is the general object of the present invention to provide a guide to assist in correctly sharpening dental curets.

Another object is to provide for proper sharpening angle on the blade of the curet.

Another object is to properly align a curet to maintain blade shape during sharpening.

A further object is to provide for variously designed curets to be sharpened using the same sharpening guide.

A still further object is to provide a method for using a sharpening guide for dental curets to maintain the appropriate blade angle and shape.

These and other objects and advantages and the manner in which they are achieved will be made apparent in the following specification and claims.

In carrying out the objectives of the invention, a sharpening guide is provided and a procedure for using the guide for sharpening dental curets is set forth. The guide includes a base member, positioning means on the base member for positioning the blade of the curet, sighting means on the base member for aligning the handle or the lower shank of the curet so that the face of the blade repeatedly assumes the same position for various curets, and stone guide means on the base member for aligning a sharpening stone adjacent the blade of the curet and at an angle to the face of the blade. The procedure for using the guide for sharpening a curet includes positioning and aligning the curet with respect to the guide, positioning a sharpening stone adjacent to the blade of the curet at an angle to the face of the blade by aligning it with a line on the sharpening guide, and reciprocating and sharpening stone while maintaining its angle with respect to the curet.

BRIEF DESCRIPTION OF THE DRAWINGS

FIG. 1 is a top perspective view of the curet sharpening guide of the present invention, illustrated resting on the edge of a table top which is shown in the phantom line;

FIG. 2 is a schematic representation of the curet sharpening guide in a flattened condition;

FIG. 3 is a schematic representation of the position of the curet and sharpening stone when using the curet sharpening guide;

FIG. 4 is a fragmentary top perspective view of the blade and lower shank of a curet;

FIG. 5 is a section taken along the line 5—5 of FIG. 4;

FIG. 6 is a fragmentary schematic representation of a section of dulled curet; and FIG. 7 is a fragmentary top perspective view similar to FIG. 4 illustrating a second design of curet.

DESCRIPTION OF A PREFERRED EMBODIMENT

In order to more fully understand the operation and use of the sharpening guide of the present invention, it is necessary to be familiar with the geometry of the several types of existing dental curets.

FIG. 3 illustrates a fragmentary portion of a handle 10 of a dental curet. Attached to the handle is shank 12. The shank tapers into an elongated lower shank 14. At the end of the lower shank is blade 16 of the curet. Curets may be formed with any number of bends in the shank, which is done so that proper access to tooth surfaces may be attained. Thus, the blade may be oriented differently with respect to the handle for each type of curet. It should be noted that the shank may be bent fore to aft as well as side to side as shown in the drawing.

An alternate design of a dental curet is also illustrated in dashed line. In FIG. 3 Handle 10' and blade 16' are substantially the same as with the first described curet. The difference is that lower shank 14' may be attached to blade 16' differently for variously designed curets. This will be discussed in further detail hereinafter.

The tip of a common or Universal dental curet is illustrated in FIG. 4. It includes lower shank 14 which is curved and beveled at its end to form blade 16. The top, flattened portion of the blade forms a face 18. The rounded bottom portion forms the blade base 20. Cutting edges 22 are formed at the junction of lateral rounded surfaces 24 and the face of the blade. Toe 26 of the blade is uniformly rounded.

FIG. 7 illustrates the tip of a similar, but modified, dental curet blade 16'. In this, the Gracey curet, lower shank 14' does not lie in a plane perpendicular to the face 18' of the blade. The base 20', lateral surfaces 24', toe 26' and cutting edges 22' and 22'' are all similar to those of the Universal curet blade 16. However, only cutting edge 22' on the convex side of the blade and shank is commonly used and thus needs sharpening.

A cross section of blade 16 of the Universal curet is shown in FIG. 5. The Gracey curet of FIG. 7 has an identical cross section even though the attachment of blade 16' to lower shank 14' is at an angle. The importance of this lies in the fact that the blades of various curets may be repeatably aligned in the same position, although the handles of the curets must be oriented differently (FIG. 3) for each kind of curet to accomplish the blade alignment.

Thus, if the style of curet is known, and this can be determined by observation and is usually imprinted on the handle, it is possible to position the handle or lower shank so that the blade assumes its regular repeatable position.

The dental curet sharpening guide of the present invention is shown in FIG. 1 generally at 28. It includes a base member 30 which is preferably made of rigid material. It also preferably is configured such that one side thereof is arranged to face and fit over the edge of a table top, such as is shown in phantom line at 32. It may be permanently affixed to the table top by adhesives or the like.

Preferably, two substantially planar surfaces are provided on the other side of the base member, one surface 34 being arranged substantially horizontally and the other surface 36 being arranged substantially vertically below the horizontal surface.

Positioning means for positioning or locating blade 16 of a curet with respect to sharpening guide 28 is provided on base member 30. Preferably the positioning means comprises a point 38 on vertical surface 36 defined by a vertex of angularly divergent lines.

Sighting means is provided on base member 30 for aligning handle 10 of the curet so that blade 16 repeatably assumes the same position for various curets. This preferably comprises a plurality of sections 40 at angularly divergent locations from point 38. The sections may be either a space or a line, such as central line 40', and may be provided with suitable coloring or identifying data. Preferably the sections lie on horizontal surface 34.

The sighting means may continuously extend onto vertical surface 36. A vertex of angularly divergent lines providing an upwardly opening V-shape is formed at positioning point 38.

As best shown in FIG. 2, sections 40 are angularly bent as they pass corner line 42, which represents the joint of horizontal surface 34 and vertical surface 36. This is to accommodate the parallax introduced by viewing the sharpening guide from above at approximately 60 degrees from horizontal, as apparent in FIG. 3.

Stone guide means is provided on sharpening guide 28. Preferably it comprises a pair of angularly divergent stone lines 44 extending downwardly from a vertex at positioning point 38. Each of the lines is a guide for aligning a sharpening stone 46, shown schematically in FIG. 3. One side of blade 16 is sharpened using one line, and the other side using the other line. The stone lines are preferably at an acute angle of from seventy to eighty degrees, preferably seventy-eight degrees from the face 18 of blade 16. Only one blade is used at a time, however both lines are needed since some curets are sharpened on one side and some on the other, and Universal curets are normally sharpened on both sides of the blade.

OPERATION

FIG. 6 schematically illustrates a section of a dulled curet. Through normal wear, cutting edge 22 has become rounded. The original lateral surface 24 is projected along a line 48. In order to restore cutting edge 22 to its proper angle it is necessary to remove a portion of the lateral surface up to line 50.

It is necessary to sharpen the curet to the original cutting edge angle of approximately seventy-eight degrees. The line illustrated at 52 would produce too dull of an angle, and conversely, line 54 would produce too sharp of an angle.

To use sharpening guide 28 to obtain this correct angle on blade 16, the curet is aligned with the sharpening guide according to the following procedure. As shown in FIG. 3, the blade is positioned adjacent positioning point 38, with toe 26 facing directly away from vertical surfaces 36 of the sharpening guide.

Next, the blade must be oriented to have a substantially horizontal face 18. As has been previously discussed, curets are of various configurations. The kind of curet is determined and handle 10 or lower shank 14 is aligned with a section 40 of the sighting means, such that the blade is oriented properly. For instance, the lower shank 14 of a Universal curet is aligned along the section denoted by the central line 40'. The handles 10 of various Gracey curets may be aligned with various other sections, each having their corresponding proper position. In use, it is a simple matter to sight past the lower shank of the Universal curets to the proper section. However, because of the nature of the angles in the shank of the Gracey curets the procedure of sighting past the handles is used.

Sharpening stone 46 is then aligned with one of stone lines 44. Since the face 18 of blade 16 has been made horizontal, the sharpening stone assumes a proper and exact angle adjacent to the blade.

Stone 46 is then reciprocated along the length of line 44 while maintaining its angle with respect to blade 16. In this manner lateral surface 24 is abraded forming a new, sharp cutting edge 22.

With a Universal curet it may then be desirable to reposition sharpening stone 46 along the other stone line 44 and repeat the sharpening process. Gracey curets, however, are normally sharpened on just one side, although some are sharpened on the right side and some on the left side as their configuration dictates.

It can be seen that a useful tool has been provided by the present invention which accomplishes the objects set forth and simplifies the error prone procedure of sharpening dental curets. Obvious changes and modifications may be made to the structure without departing from the spirit and scope of the invention.

Having thus described our invention in its preferred embodiment, we claim:

1. A sharpening guide for curved dental curet blades having a top flat surface and at least one angled side surface that joins with the top surface in a top cutting edge, said guide comprising (a) a base member arranged to be configured for fitting over a right angle edge of a table top, (b) said base member having opposite side surfaces with one side surface being arranged to face and engage the right angle edge of a table top and the other side surface having first and second substantially planar surface portions arranged to be disposed at a right angle to each other;

(c) said first surface portion being arranged substantially horizontally upon fitting said base member over the edge of a table and said second surface portion being arranged substantially vertically;

(d) positioning means on said second surface portion of the base member for denoting a location for positioning the blade of a curet;

(e) sighting means on said first surface portion of the base member for aligning a selected part of the curet other than the blade such that the blade repeatedly assumes the same position and orientation for engagement by a manually held reciprocatable grinding stone on one side surface of the blade to sharpen its cutting edge, said sighting means comprising a plurality of sections at angularly divergent locations configured for alignment of variously shaped curets, said sighting means extending onto said second surface portion and forming a vertex of angularly divergent lines providing an upwardly opening V-shape, said sections being bent in their divergent angles at the corner of said first surface portion and said second surface portion to compensate for parallax introduced by viewing the sharpening guide from an angle; and (e) stone guide means on said second surface portion of the base member below the positioning means for aligning a sharpening stone adjacent the blade of the curet at said positioning means and at an angle to the face of the blade for grinding the side surface.

2. The sharpening guide of claim 1 wherein the positioning means comprises a point defined by said vertex of angularly divergent lines.

3. The sharpening guide of claim 1 wherein the stone guide means comprises a pair of lines, being angularly divergent and forming a vertex at the location of the positioning means, for aligning the sharpening stone to sharpen either side of the blade.

4. The sharpening guide of claim 1 wherein the stone guide means is at an acute angle of from seventy to eighty degrees to the face of the blade.

* * * * *